United States Patent [19]

Ototani

[11] Patent Number: 4,484,946

[45] Date of Patent: Nov. 27, 1984

[54] METHOD OF PRODUCING IRON-, NICKLE-, OR COBALT-BASE ALLOY WITH LOW CONTENTS OF OXYGEN, SULPHUR, AND NITROGEN

[75] Inventor: Tohei Ototani, Tokyo, Japan

[73] Assignee: Metal Research Corporation, Tokyo, Japan

[21] Appl. No.: 384,293

[22] Filed: Jun. 2, 1982

[30] Foreign Application Priority Data

Jun. 2, 1981 [JP] Japan ..... 56-83780

[51] Int. Cl.[3] ..... C21C 7/02

[52] U.S. Cl. ..... 75/58; 75/53; 75/82; 75/129; 75/130 R

[58] Field of Search ..... 75/53, 58, 82, 129, 75/130 R

[56] References Cited

U.S. PATENT DOCUMENTS 3,189,956 6/1965 Longden ..... 75/58
3,375,105 3/1968 Lynch ..... 75/58
4,217,134 8/1980 Russell ..... 75/58

*Primary Examiner*—Peter D. Rosenberg
*Attorney, Agent, or Firm*—Sughrue, Mion, Zinn, Macpeak, and Seas

[57] ABSTRACT

The disclosed method of producing an iron-, nickel-, or cobalt-base alloy with low contents of oxygen, sulphur, and nitrogen comprises steps of melting the alloy in a crucible lined with a basic refractory containing at least 40% of calcium oxide; and adding at least one additive and not more than 5% by weight of at least one flux, based on said alloy, the additive being selected from the group consisting of aluminum, aluminum alloys, silicon, silicon alloys, titanium, zirconium, niobium, boron, and rare earth elements, the flux being selected from the group consisting of oxides, silicates, carbonates, and halides of alkali and alkaline earth metals, and aluminum oxide, so that the resultant molten alloy contains 0.005 to 7.0% of aluminum, 0.005 to 7.0% of silicon, and 0.0005 to 0.005% of calcium.

11 Claims, 2 Drawing Figures

METHOD OF PRODUCING IRON-, NICKLE-, OR COBALT-BASE ALLOY WITH LOW CONTENTS OF OXYGEN, SULPHUR, AND NITROGEN

BACKGROUND OF THE INVENTION

1. Field of the Invention

This invention relates to a method of producing an iron-, nickel-, or cobalt-base alloy of high purity, and more particularly to a method of producing an alloy containing at least one major ingredient selected from the group consisting of iron (Fe), nickel (Ni), and cobalt (Co) and having low contents of oxygen, sulphur, and nitrogen.

2. Description of the Prior Art

The inventors disclosed a method of producing nickel-base alloys with low contents of oxygen and sulphur in their Japanese Pat. No. 992,541, a method of deoxidizing and desulphurizing molten steel in Japanese Patent Publication No. 849/79, and a method of producing clean steel with low contents of oxygen, sulphur, and nitrogen in their Japanese Patent Laid-open Publication No. 58,010/77.

The essence of the above-mentioned methods of the inventors is in that an iron alloy is melted in a container which is lined with a basic refractory mainly consisting of calcium oxide (CaO); and aluminum (Al) or an aluminum alloy is added into the molten iron alloy in vacuo or in an argon atmosphere, accompanied with violent agitation if necessary, so as to remove oxygen and sulphur from the molten iron alloy by aluminum (Al), while the calcium oxide (CaO) in the basic refractory of the container lining is reduced by aluminum (Al) to isolate calcium (Ca), which calcium (Ca) reacts with oxygen ($O_2$) and sulphur (S) in the molten iron alloy to form calcium oxide (CaO) and calcium sulfide (CaS), whereby the iron alloy is deoxidized and desulphurized.

In general, calcium (Ca) has a high vapor pressure and evaporates at a temperature above 1,480° C. Although it is known to deoxidize a molten metal by adding aluminum (Al) or titanium (Ti) or cesium (Ce) therein and then to desulphurize, deoxidize, and denitrify the molten metal by adding calcium (Ca) or a calcium alloy therein, such known use of calcium (Ca) has shortcomings in that the yield of calcium (Ca) is low due to the above-mentioned properties thereof and that the desulphurization, deoxidation, and denitrification are not very effective. On the other hand, the above-mentioned methods disclosed by the inventors produce calcium (Ca) by reduction along the entire contact surface between the molten metal and the refractory lining, so that effective desulphurization, deoxidation, and denitrification are effected as the reduced calcium (Ca) evaporates and disperses through the molten metal. The methods previously disclosed by the inventors are further characterized in that the contact area between calcium (Ca) and the molten metal is larger than that in the prior art, and a part of the calcium (Ca) is alloyed with metallic elements in the molten metal, so that the content thereof can be decreased to 0.001 to 0.03%. Such low content thereof indicates that the desulphurization, deoxidation, and denitrification are effectively carried out, as a salient feature of the methods.

However, the previously disclosed methods of the inventors have shortcomings in that, when the methods are carried out repeatedly by using the same container lined with a basic refractory mainly consisting of calcium oxide (CaO) as described above, the contents of oxygen and sulphur in the produced alloy increase with the number of repetition of using the methods. More particularly, the methods previously disclosed by the inventors are accompanied by a phenomenon that if the methods of producing the alloy are repeatedly carried out by using the same container, the rate of deoxidation and the rate of desulphurization are deteriorated.

SUMMARY OF THE INVENTION

Therefore, an object of the present invention is to obviate and eliminate the above-mentioned shortcomings of the methods of production previously disclosed by the inventors and to provide an improved method of producing an iron-, nickel-, or cobalt-base alloy of high purity.

To fulfil the above object, an object of the present invention is to provide a method of the invention for producing an iron-, nickel-, or cobalt-base alloy with low contents of oxygen, sulphur, and nitrogen comprises steps of melting an alloy in a container such as a crucible or a furnace lined with a basic refractory containing at least 40% of calcium oxide (CaO), said alloy consisting essentially of at least one major ingredient selected from the group consisting of iron (Fe), nickel (Ni), and cobalt (Co); and adding at least one additive and not more than 5% by weight of at least one flux, based on the molten alloy, into said molten alloy in vacuo or in an argon gas atmosphere, said additive being selected from the group consisting of aluminum (Al), aluminum alloys, silicon (Si), and silicon alloys, while said flux being selected from the group consisting of oxides, silicates, carbonates, and halides of alkali and alkaline earth metals, under non-oxidizing atmosphere, whereby the molten alloy contains 0.005 to 7.0% of aluminum (Al), 0.005 to 7.0% of silicon (Si), and 0.0005 to 0.005% of calcium (Ca), and casting said molten alloy into a mold.

Another object of the present invention is to provide a method of producing an iron-, nickel-, and cobalt-base alloy with low contents of oxygen, sulphur, and nitrogen, comprising steps melting an alloy in a container such as a crucible or furnace lined with a basic refractory containing at least 40% of calcium oxide (CaO), said alloy consisting essentially of at least one major ingredient selected from the group consisting of iron (Fe), nickel (Ni), and cobalt (Co); adding at least one additive and not more than 5% of a flux, based on the molten alloy, into said molten alloy in a non-oxidizing atmosphere, said additive being selected from the group consisting of aluminum (Al), aluminum alloys, silicon (Si), and silicon alloys, while said flux containing aluminum oxide ($Al_2O_3$) and at least one compound selected from the group consisting of oxides, silicates, carbonates, and halides of alkali and alkaline earth metals, under non-oxidizing atmosphere, whereby the molten alloy contains 0.005 to 7.0% of aluminum, 0.005 to 7.0% of silicon, and 0.0005 to 0.005% of calcium, and casting said molten alloy into a mold.

A further object of the present invention is to provide a method of producing an iron-, nickel-, and cobalt-base alloy with low contents of oxygen, sulphur, and nitrogen, comprising steps melting an alloy in a container such as a crucible or furnace lined with a basic refractory containing at least 40% of calcium oxide (CaO), said alloy consisting essentially of at least one major ingredient selected from the group consisting of iron (Fe), nickel (Ni), and cobalt (Co); adding first and second additives and not more than 5% of a flux, based on the molten alloy, into said molten alloy in a non-oxidizing atmosphere, said first additive being selected from the group consisting of aluminum (Al), aluminum alloys, silicon (Si), and silicon alloys, said second additive being selected from the group consisting of titanium (Ti), zirconium (Zr), niobium (Nb), boron (B), and rare earth elements, while said flux containing at least one compound selected from the group consisting of oxides, silicates, carbonates, and halides of alkali and alkaline earth metals, under non-oxidizing atmosphere, whereby the molten alloy contains 0.005 to 7.0% of aluminum, 0.005 to 7.0% of silicon, and 0.0005 to 0.005% of calcium, and casting said molten alloy into a mold.

A still further object of the present invention is to provide a method of producing an iron-, nickel-, and cobalt-base alloy with low contents of oxygen, sulphur, and nitrogen, comprising steps of melting an alloy in a container lined with a basic refractory containing at least 40% of calcium oxide (CaO), said alloy consisting essentially of at least one major ingredient selected from the group consisting of iron (Fe), nickel (Ni), and cobalt (Co); adding first and second additives and not more than 5% of a flux, based on the molten alloy, into said molten alloy in a non-oxidizing atmosphere, said first additive being selected from the group consisting of aluminum (Al), aluminum alloys, silicon (Si), and silicon alloys, said second additive being selected from the group consisting of titanium (Ti), zirconium (Zr), niobium (Nb), boron (B), and rare earth elements, while said flux containing aluminum oxide ($Al_2O_3$) and at least one compound selected from the group consisting of oxides, silicates, carbonates, and halides of alkali and alkaline earth metals, under non-oxidizing atmosphere, whereby the molten alloy contains 0.005 to 7.0% of aluminum, 0.005 to 7.0% of silicon, and 0.0005 to 0.005% of calcium, and casting said molten alloy into a mold.

Another object of the present invention is to provide a method of producing an iron-, nickel-, and cobalt-base alloy with low contents of oxygen, sulphur, and nitrogen, comprising steps of charging a molten alloy in a container lined with a basic refractory containing at least 40% of calcium oxide (CaO), said alloy consisting essentially of at least one major ingredient selected from the group consisting of iron (Fe), nickel (Ni), and cobalt (Co); adding at least one additive and not more than 5% of a flux, based on the molten alloy, into said alloy in a non-oxidizing atmosphere, said additive being selected from the group consisting of aluminum (Al), aluminum alloys, silicon (Si), and silicon alloys, while said flux containing at least one compound selected from the group consisting of oxides, silicates, carbonates, and halides of alkali and alkaline earth metals, under non-oxidizing atmosphere, whereby the molten alloy contains 0.005 to 7.0% of aluminum, 0.005 to 7.0% of silicon, and 0.0005 to 0.005% of calcium, and casting said molten alloy into a mold.

In a preferred embodiment, said non-oxidizing atmosphere is vacuum or an argon gas atmosphere.

It is preferable that said flux consists of calcium oxide and calcium fluoride ($CaF_2$).

It is preferable that said flux consists of calcium oxide, calcium fluoride, and aluminum oxide.

It is preferable that said basic refractory contains at least 60% of calcium oxide.

It is preferable that said basic refractory contains at least 80% of calcium oxide.

It is preferable that said basic refractory contains at least 90% of calcium oxide.

It is preferable that said container is a crucible or ladle.

BRIEF DESCRIPTION OF THE DRAWINGS

For a better understanding of the invention, reference is made to the accompanying drawings, in which.

DESCRIPTION OF THE PREFERRED EMBODIMENTS

Figure 1:
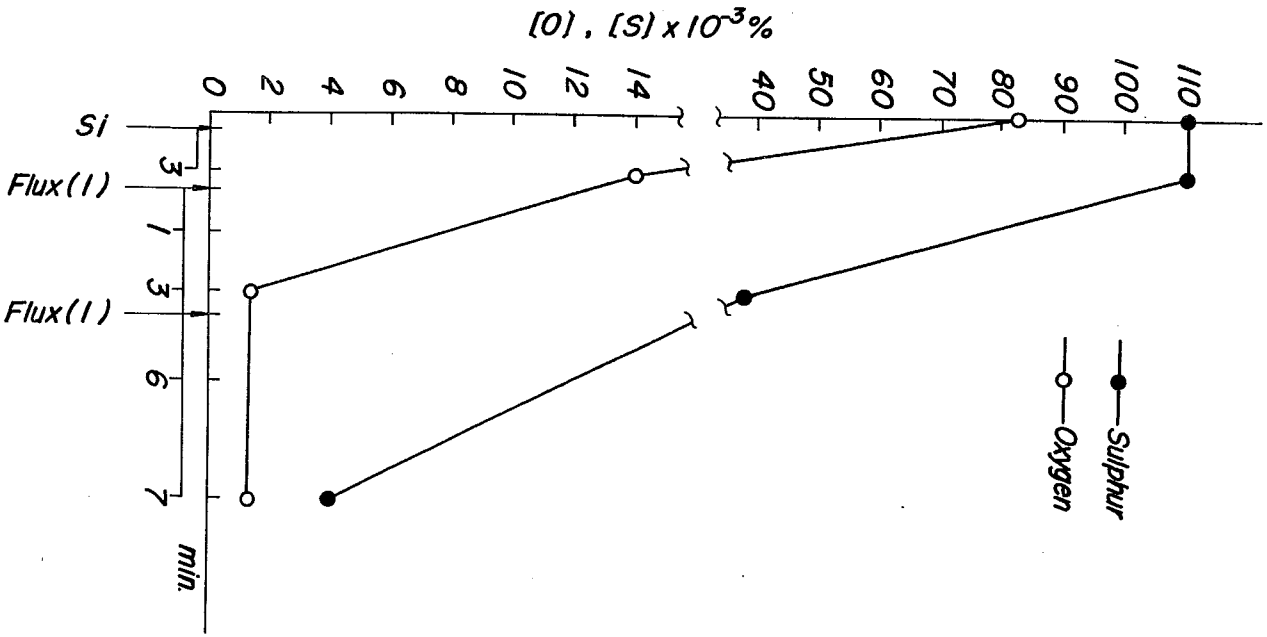
FIG. 1 is a graph showing the variations of the total oxygen content and the total sulphur content in molten iron with the time after addition of 0.5% of silicon (Si) therein and ensuing addition of 5% of a flux consisting of calcium oxide (CaO) and calcium fluoride ($CaF_2$) therein.

The inventors disclosed a method of producing clean steel with low contents of oxygen and sulphur in the Japanese Patent Laid-open Publication No. 58,010/77, which method comprised steps of melting a steel in a melting furnace which was lined with basic refractory containing at least 60% of calcium oxide (CaO), and adding aluminum (Al) in the molten steel in vacuo or in an argon atmosphere so as to reduce the calcium oxide (CaO) in the lining refractory for generating calcium (Ca), whereby the molten steel was deoxidized, desulphurized, and denitrified by the thus generated calcium (Ca) and the molten steel contained 0.005 to 0.06% of residual aluminum (Al), 0.001 to 0.03% of residual calcium (Ca), less than 0.003% of oxygen, less than 0.010% of sulphur, and less than 0.010% of nitrogen. It has been found that repeated applications of the above-mentioned method of producing clean steel by using the same container lined with the basic refractory with high concentration of calcium oxide (CaO) result in increases in the contents of sulphur and oxygen in the molten steel with the increase of the number of using the same crucible for melting steel, as shown in Table 1.

To clarify the cause of such increases of the sulphur and oxygen contents, the inventors repeatedly melted steel by using the same crucible in each melting, which crucible was lined with calcium oxide (CaO), i.e., a calcia crucible, and found the following phenomenon.

The inner surface of the wall of a fresh calcia crucible contained 0.005% of aluminum (Al) and 0.004 to 0.017% of sulphur (S), and the repeated use of the crucible increased the contents of aluminum and sulphur; namely, the lower portion and the molten steel top level portion of the wall of the used calcia crucible contained 2.6 to 2.8% of aluminum (Al) and 1.5 to 1.9% of sulphur (S). Besides, X-ray diffraction tests confirmed the presence of calcium oxide (CaO), tricalcium aluminate ($3CaO.Al_2O_3$), and calcium sulfide (CaS) in addition to calcium hydroxide ($Ca(OH)_2$) on the surface of the wall of the used crucible.

TABLE 1

| Experiment Number | Times of using crusible | Carbon (C) (%) | Silicon (Si) (%) | Manganese (Mn) (%) | Phosphorus (P) (%) | Sulphur (S) (%) | Nickel (Ni) (%) | Chromium (Cr) (%) | Molybdenum (Mo) (%) | Oxygen (O) (ppm) |
|---|---|---|---|---|---|---|---|---|---|---|
| No. 1 | 3 times | 0.02 | 0.42 | 1.48 | 0.005 | 0.003 | 13.61 | 17.77 | 2.32 | 7 |
| No. 2 | 4 times | 0.03 | 0.41 | 1.60 | 0.004 | 0.005 | 13.58 | 17.63 | 2.31 | 11 |
| No. 3 | 6 times | 0.03 | 0.38 | 1.69 | 0.004 | 0.010 | 13.42 | 17.57 | 2.25 | 16 |

After a series of experiments, the inventors have attained to a novel finding that, when the method of producing pure steel as disclosed in their Japanese Patent Laid-open Publication No. 58,010/77 is carried out, if at least one flux and at least one additive are added in the molten steel, the sulphur content in the refined molten steel can be kept low and any reduction of the deoxidizing rate and the desulphurizing rate can be prevented even after a large number of repeated use of one specific crucible, said flux being selected from the group consisting of oxides, silicates, carbonates, and halides of alkali and alkaline earth metals, while said additive being selected from the group consisting of aluminum (Al), aluminum alloys, silicon (Si), and silicon alloys. The present invention is based on such finding.

In an embodiment of the method of the present invention, after a molten metal such as carbon steel or alloy steel is charged in a container of melting furnace or a ladle, if at least one of aluminum (Al)) and silicon (Si) and at least one of titanium (Ti), zirconium (Zr), niobium (Nb), boron (B), and rare earth elements are added in the molten metal in vacuo or in an argon gas atmosphere, the thus added elements or metals react with non-metallic oxide inclusions in the molten metal and oxygen and sulphur (S) dissolved in the molten metal, so as to generate oxides, nitrides, and sulfides. Whereby, deoxidation, denitrification, and desulphurization are effected. Such effects of the invention will be explained now by quoting an example which adds aluminum (Al), titanium (Ti), and cerium (Ce).

The thus added elements generate compounds such as aluminum oxide ($Al_2O_3$), titanium oxide (TiO), cerium oxide ($Ce_2O_3$), aluminum nitride (AlN), titanium nitride (TiN), cerium nitride (CeN), cerium sulfide (CeS), and titanium sulfide ($TiS_2$), and excess aluminum (Al), titanium (Ti), and cerium (Ce) reduce the calcium oxide (CaO) in the refractory lining of the container of furnace or the ladle so as to generate calcium (Ca). In the case of a vacuum treatment of molten steel, deoxidation by carbon (C) occurs, and it is also known that the following reaction between the calcium oxide (CaO) in the refractory lining and carbon (C) occurs.

$$CaO + C = Ca_{(gas)\ or\ (liquid)} + CO_{(gas)} \quad (1)$$

More particularly, in the vacuum refining, the lower the operating pressure is and the larger the active amount of carbon (C) is, the more easily the reaction of the equation (1) proceeds. However, if elements with a large affinity with carbon (C) such as elements of the V group, the titanium (Ti) group, and the chromium (Cr) group exist in the molten steel, the deoxidizing power of carbon (C) is considerably reduced. Thus, the reduction of calcium oxide (CaO) by aluminum (Al), titanium (Ti), or cerium (Ce) in vacuo or in an argon gas atmosphere appears to occur in accordance with the following equations.

$$3CaO + 2Al = 3Ca_{(gas)\ or\ (liquid)} + Al_2O_3 \quad (2)$$

$$CaO + Ti = Ca_{(gas)\ or\ (liquid)} + TiO \quad (3)$$

$$3CaO + 2Ce = 3Ca_{(gas)\ or\ (liquid)} + Ce_2O_3 \quad (4)$$

It is noted that, if the molten steel is exposed to air, the molten steel absorbs oxygen from the air, so that the reduction of calcium oxide (CaO) becomes difficult and residual calcium in the molten steel cannot be expected. The calcium (Ca) thus generated by the equations (1) through (4) reacts with sulphur in the molten steel and with the remaining oxygen and nitrogen after the deoxidation and denitrification by the above-mentioned aluminum (Al), titanium (Ti), or cerium (Ce), so as to produce calcium sulfide (CaS) and calcium nitride ($Ca_3N_2$) as shown by the following equations.

$$Ca_{(gas)\ or\ (liquid)} + S = CaS \quad (5)$$

$$3O_2 + 4Al = 2Al_2O_3 \quad (6)$$

$$O_2 + 2Ti = 2TiO \quad (7)$$

$$3O_2 + 4Ce = 2Ce_2O_3 \quad (8)$$

$$Ti + N = TiN \quad (9)$$

$$3Ca + 2N = Ca_3N_2 \quad (10)$$

$$Al + N = AlN \quad (11)$$

$$Ce + N = CeN \quad (12)$$

Especially, if a large amount of aluminum (Al) is added in an argon gas atmosphere, slag layers with a large desulphurizing ability such as tricalcium aluminate ($3CaO.Al_2O_3$) are produced on the surface of the lining refractory, and cerium contributes to direct desulphurization.

The invention will be described in further detail now by referring to examples.

EXAMPLE 1

Starting material of 2 kg of electrolytic iron was melted in a calcium oxide (CaO) crucible with an inner diameter of 80 mm by using a vacuum type high-frequency induction furnace. In the beginning, the heating was carried out in vacuo and then an argon gas atmosphere was applied after the electrolytic iron was melted. At the melting temperature of 1,580° C., 0.1% by weight of sulphur powder, based on the weight of the molten iron, was added to the surface of the molten iron, so that the initial sulphur (S) content in the molten iron was adjusted to be 0.11%. At this stage, the initial oxygen content was 0.083% and the initial nitrogen content was 0.01%.

To this molten iron, 0.5% of metallic silicon (Si) was added, and then 60 grams of a flux made by mechanically mixing 7 parts of calcium oxide (CaO) and 3 parts of calcium fluoride ($CaF_2$) was added to the surface of the molten iron, and thereafter 40 grams of the same flux was added into the surface of the molten iron. Altogether, 100 grams of the flux was added to the surface of the molten iron, or at a rate of 5% by weight based on the molten iron, and the progress of deoxidation and desulphurization was checked at suitable time intervals. The result is shown in FIG. 1.

Separately, the same amount of the same electrolytic iron as those of the preceding sample was melted, and metallic silicon (Si) was similarly added therein. A flux was prepared by mechanically mixing 6 parts of calcium oxide (CaO), 3 parts of calcium fluoride ($CaF_2$), and 1 part of aluminum oxide ($Al_2O_3$), and 80 grams, or 4% by weight based on the molten iron, of the flux thus prepared was added to the molten iron in two steps, namely 60 grams at first and 20 grams later. The progress of deoxidation and desulphurization was checked at suitable time intervals. The result is shown in FIG. 2.

Figure 2:
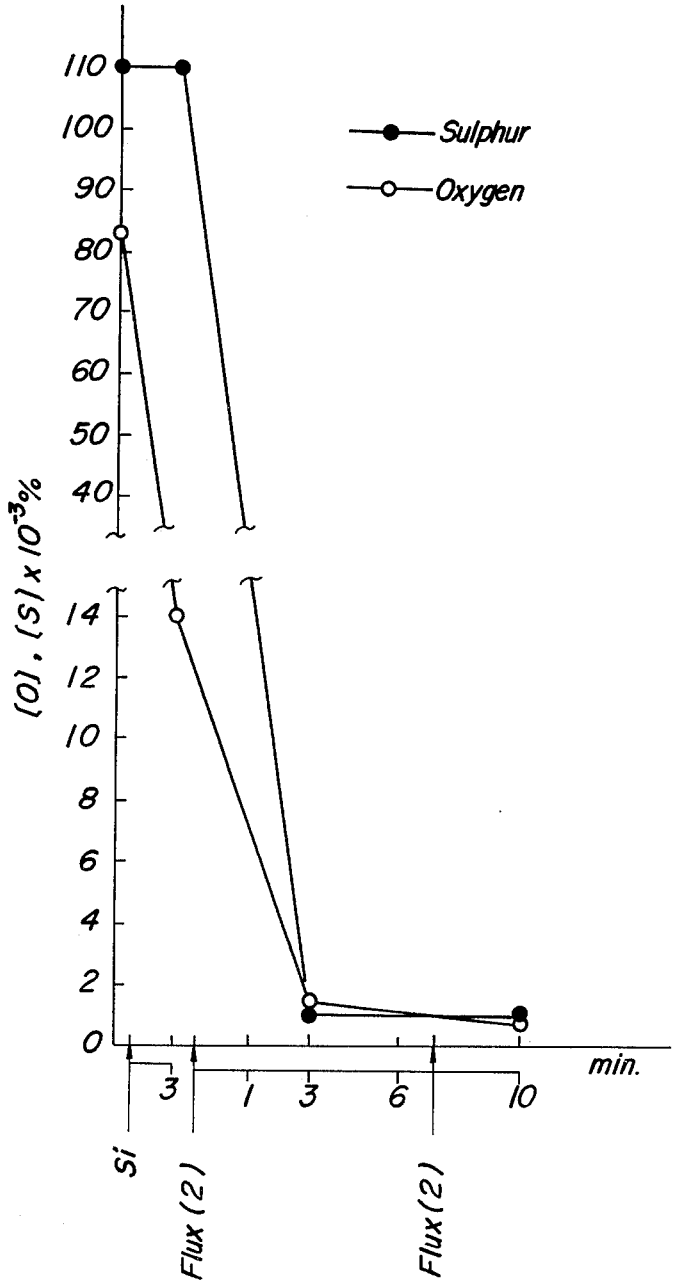
FIG. 2 is a graph similar to that of FIG. 1, except that 4% of a flux consisting of calcium oxide (CaO), calcium fluoride ($CaF_2$), and aluminum oxide ($Al_2O_3$) is used instead of the above-mentioned binary flux.

To obtain the data as shown in FIG. 1 and FIG. 2, the total amount of oxygen and the totable amount of sulphur in the molten iron were measured at 1,600° C. at preselected time intervals by sucking samples of the molten iron through an opaque quartz tube with a 7 mm diameter and analyzing the thus sucked samples. As can be seen from the figures, the content of sulphur (S) 3 minutes after the addition of 0.5% of silicon (Si) was 0.11% and no significant change was found, while the content of oxygen at that time was reduced to 0.014%, which was close to the equilibrium value by silicon deoxidation, i.e., 0.012%.

In the case of the CaO-$CaF_2$ flux (the flux (1) of FIG. 1), in 3 minutes after the addition thereof onto the surface of the molten iron, the oxygen content was reduced to 0.0014% and the sulphur (S) content was reduced to 0.038%. In 7 minutes after the first addition of the flux (1) the oxygen content was reduced to 0.0013% and the sulphur (S) content was reduced to 0.004%. Although not shown in FIG. 1, the nitrogen content was reduced to one half or to 0.004%.

In the case of CaO-$CaF_2$-$Al_2O_3$ flux (the flux (2) of FIG. 2), in 3 minutes after the addition thereof onto the surface of the molten iron, the oxygen content was reduced to 0.0014% and the sulphur (S) content was reduced to 0.001%. In 10 minutes after the first addition of the flux (2), the oxygen content was reduced to 0.0009%, the sulphur (S) content was reduced to 0.001%, the nitrogen content was reduced to 0.001%, and the calcium (Ca) content was reduced to 0.001%.

As can be seen from the data of the above-mentioned two experiments, when the CaO-$CaF_2$ flux or the CaO-$CaF_2$-$Al_2O_3$ flux was used in a non-oxidizing atmosphere such as the argon atmosphere, the degree of deoxidation and desulphurization of the molten iron was considerably improved as compared with that obtained by the addition of silicon (Si) alone.

EXAMPLE 2

One calcium oxide (CaO) crucible with an inner diameter of 80 mm was repeatedly used for melting a number of samples each of which consisted of 2 kg of SUS 316 stainless steel, by using a vacuum type high-frequency induction furnace, so as to check the contamination due to the sulphur concentration at the wall of the crucible and the effectiveness of flux in preventing such contamination.

When the SUS 316 stainless steel containing 0.023% of sulphur (S) was melted at 1,540° C., 0.1% of sulphur powder was added to the surface of the molten steel, and then 0.15% of aluminum (Al) was added thereto, and 12 minutes later the molten stainless steel was cast into a metallic mold.

The melting was effected twice successively by using the same calcium oxide (CaO) crucible, and a part of the surface of the wall of the crucible was cut out to measure the sulphur concentration therein.

Then, in the third time of the melting by using the same calcium oxide (CaO) crucible, four flux packages were charged in the crucible together with the 2 kg SUS 316 stainless steel sample. Each of the flux packages contained 20 grams of a flux wrapped by powder paper, and the flux packages were placed at the bottom and by the sidewall of the crucible. The flux thus charged was prepared by mechanically mixing 6 parts by weight of calcium oxide (CaO), 3 parts by weight of calcium fluoride ($CaF_2$), and 1 part by weight of aluminum oxide ($Al_2O_3$). The melting of the stainless steel was carried out in vacuo in the beginning and in an argon gas atmosphere from an intermediate stage thereof. After the charged material was melted, 0.1% of sulphur powder was added to the surface of the molten steel and then five flux packages each of which contained 20 grams of the above-mentioned flux were added to the surface of the molten steel. After being kept still for 16 minutes, the molten stainless steel was cast into a metallic mold. Upon completion of the third melting, a part of the surface of the wall of the crucible was cut out to check the sulphur concentration therein.

The result of the tests was as follows: namely, the wall of the calcium oxide (CaO) crucible which had not been used contained 0.017% of sulphur (S), and after the second melting the wall of the crucible contained 1.73% of sulphur (S), and after the third melting which used the flux, the content of sulphur (S) in the wall of the crucible was 0.45%. Thus, it was confirmed that the sulphur (S) content of the crucible wall after the second melting was reduced to about one fourth by the flux used in the third melting.

EXAMPLE 3

A crucible with an inner diameter of 70 mm was prepared by using calcium oxide (CaO) of special class for chemical reagent. Starting materials including 2 kg of Hastelloy C (15% of chromium (Cr), 15% of molybdenum (Mo), 3.5% of tungsten (W), 5.5% of iron (Fe), 0.01% of sulphur (S), and the remainder of nickel (Ni)) and 100 grams of a flux consisting of 7 parts of calcium oxide (CaO) and 3 parts of calcium fluoride ($CaF_2$) was melted in the crucible thus prepared in vacuo by using a vacuum type high-frequency induction furnace. After the starting material in the crucible was melted at 1,560° C., the atmosphere was changed to that of argon at one half atmospheric pressure. Two additives, i.e., 0.3% of manganese (Mn) and 0.3% of silicon (Si), were added in the melt in the crucible, and 1 minute later 0.2% of aluminum (Al) was added therein, and the melt was left still for 5 minutes. Thereafter, 0.06% of ferroboron (with 0.005% of boron (B)) and mischmetal was added therein, and the atmosphere was evacuated again to $10^3$ Torr, and then the melt was cast into a first ingot by using a water-cooled copper crucible with a diameter of 40 mm. The initial oxygen content was 0.02% and the initial nitrogen content was 0.01%.

A second ingot was prepared from the Hastelloy C with the same composition as that of the first ingot by repeatedly using the same calcium oxide (CaO) crucible, the same flux, and the same melting conditions as those for the first ingot. Thereafter, a third ingot was prepared similarly.

Table 2 shows the contents of carbon (C), silicon (Si), manganese (Mn), aluminum (Al), calcium (Ca), oxygen ($O_2$), and sulphur (S) in the first, second, and third ingots thus prepared.

TABLE 2

| | Unit: % | | | | | | |
|---|---|---|---|---|---|---|---|
| Ingot | Carbon (C) | Silicon (Si) | Manganese (Mn) | Aluminum (Al) | Calcium (Ca) | Oxygen ($O_2$) | Sulphur (S) |
| First | 0.026 | 0.22 | 0.06 | 0.16 | 0.004 | 0.0020 | 0.004 |
| Second | 0.011 | 0.21 | 0.05 | 0.06 | 0.004 | 0.0017 | 0.004 |
| Third | 0.003 | 0.14 | 0.26 | 0.17 | 0.004 | 0.0021 | 0.005 |

As apparent from Table 2, the invention substantially eliminates any increase of sulphur (S) and oxygen ($O_2$) contents in the metal by using the flux even if the same calcium oxide (CaO) crucible is repeatedly used.

In the foregoing description of the present invention, the "argon gas atmosphere" means that argon gas is blown into molten metal in an open furnace or a closed furnace during the treating of the molten metal, or that an argon gas atmosphere is formed on the surface of molten metal in a closed furnace so as to treat the molten metal under the condition of being covered by the argon gas.

The reason why the refractory to be used in the invention for lining the container for treating the molten metal is required to be a basic refractory containing more than 40% of calcium oxide (CaO) is in that, if the content of calcium oxide (CaO) is less than 40%, the amount of calcium (Ca) to be reduced from the calcium oxide (CaO) in the basic refractory by aluminum (Al), aluminum alloys, silicon (Si), or silicon alloys added in the molten metal is too small, so that oxygen and sulphur in the molten metal cannot be sufficiently deoxidized and desulphurized by the thus reduced calcium (Ca).

A melt of the iron-base alloy or the like produced by the method according to the present invention contains residual aluminum (Al) and silicon (Si) inevitably brought therein from scrap and other starting materials and residual calcium (Ca) from the lining material of calcium oxide (CaO). If the contents of such residual aluminum, silicon, and calcium are less than 0.005%, less than 0.005%, and less than 0.0005%, respectively, the desired alloy with low contents of oxygen, sulphur, and nitrogen cannot be obtained. Accordingly, the alloy according to the present invention must contain at least 0.005% of aluminum, at least 0.005% of silicon, and at least 0.0005% of calcium.

The amount of the residual aluminum or the residual silicon in the alloy of the invention after addition of such elements therein as additives therein can be determined depending on the desired use of such alloys, but in the alloys for practical applications, the concentration of aluminum or silicon is usually less than 7.0%. More particularly, in the alloys of the invention containing at least one of iron, nickel, and cobalt, the presence of aluminum therein contributes to improvement of both the ductility and the heat-resistivity of the alloys by decreasing the crystal grain size, but the presence of aluminum in excess of 7.0% contributes only little to such improvement. The presence of silicon in such alloys of the invention tends to improve both the heat-resistivity and the electric characteristics thereof, but the presence of silicon in excess of 7.0% renders the alloys difficult to machine. The presence of calcium in such alloys of the invention contributes to reduction of the crystal grain size and control of the configuration of impurities therein, so as to improve the ductility, workability, and other mechanical properties of the alloys. However, the concentration of calcium in excess of 0.005% renders the alloys difficult to melt, so that the upper limit of calcium concentration in the alloys of the invention is selected to be 0.005%.

As described in the foregoing, the method according to the present invention ensures production of a clean iron-, nickel-, or cobalt-base alloy with low contents of oxygen, sulphur, and nitrogen, even if a container lined with calcium oxide (CaO) is used repeatedly for the production of the alloy.

What is claimed is:

1. A method of producing an iron-, nickel-, and cobalt-base alloy having an oxygen content of less than 0.003%, a sulphur content of less than 0.010%, and a nitrogen content of less than 0.010%, comprising the steps of:

(a) melting an alloy in a container selected from the group consisting of a lime crucible, a lime crucible furnace and a ladle lined with a basic refractory consisting of at least 40% calcium oxide (CaO), wherein said alloy consists essentially of at least one major ingredient selected from the group consisting of iron (Fe), nickel (Ni), and cobalt (Co);

(b) adding at least one additive and not more than 5% of a flux, based on the molten alloy, into said molten alloy in an atmosphere selected from the group consisting of a non-oxidizing atmosphere and a vacuum, wherein said additive is selected from the group consisting of aluminum (Al), aluminum alloys, silicon (Si), and silicon alloys, and wherein said flux contains at least one compound selected from the group consisting of oxides, silicates, carbonates, and halides of alkali and alkaline earth metals;

(c) desulphurizing, deoxidizing and denitrifying said molten alloy under an atmosphere selected from the group consisting of a non-oxidizing atmosphere and a vacuum, whereby the molten alloy contains a 0.005 to 7.0% of residual aluminum, 0.005 to 7.0% of residual silicon, and 0.0005 to 0.005% of residual calcium; and (d) casting said molten alloy into a mold.

2. A method of producing an iron-, nickel-, and cobalt-base alloy having an oxygen content of less than 0.003%, a sulphur content of less than 0.010%, and a nitrogen content of less than 0.010%, comprising the steps of:

(a) melting an alloy in a container selected from the group consisting of a lime crucible, a lime crucible furnace and a ladle lined with a basic refractory consisting of at least 40% calcium oxide (CaO), wherein said alloy consists essentially of at least one major ingredient selected from the group consisting of iron (Fe), nickel (Ni), and cobalt (Co);

(b) adding at least one additive and not more than 5% of a flux, based on the molten alloy, into said molten alloy in an atmosphere selected from the group consisting of a non-oxidizing atmosphere and a vacuum, wherein said additive is selected from the group consiting of aluminum (Al), aluminum alloys, silicon (Si), and silicon alloys, and wherein said flux contains aluminum oxide ($Al_2O_3$) and at least one compound selected from the group consisting of oxides, silicates, carbonates, and halides of alkali and alkaline earth metals;

(c) desulphurizing, deoxidizing and denitrifying said molten alloy under an atmosphere selected from the group consisting of a non-oxidizing atmosphere and a vacuum, whereby the molten alloy contains 0.005 to 7.0% of residual aluminum, 0.005 to 7.0% of residual silicon, and 0.0005 to 0.005% of residual calcium; and (d) casting said molten alloy into a mold.

3. A method of producing an iron-, nickel-, and cobalt-base alloy having an oxygen content of less than 0.003%, a sulphur content of less than 0.010%, and a nitrogen content of less than 0.010%, comprising the steps of:

(a) melting an alloy in a container selected from the group consisting of a lime crucible, a lime crucible furnace and a ladle lined with a basic refractory consisting of at least 40% calcium oxide (CaO), wherein said alloy consists essentially of at least one major ingredient selected from the group consisting of iron (Fe), nickel (Ni), and cobalt (Co);

(b) adding first and second additives and not more than 5% of a flux, based on the molten alloy, into said molten alloy in an atmosphere selected from the group consisting of a non-oxidizing atmosphere and a vacuum, wherein said first additive is selected from the group consisting of aluminum (Al), aluminum alloys, silicon (Si), and silicon alloys, wherein said second additive is selected from the group consisting of titanium (Ti), zirconium (Zr), niobium (Nb), boron (B), and rare earth elements, and wherein said flux contains at least one compound selected from the group consisting of oxides, silicates, carbonates, and halides of alkali and alkaline earth metals;

(c) desulphurizing, deoxidizing and dentrifying said molten alloy under an atmosphere selected from the group consisting of a non-oxidizing atmosphere and a vacuum, whereby the molten alloy contains 0.005 to 7.0% of residual aluminum, 0.005 to 7.0% of residual silicon, and 0.0005 to 0.005% of residual calcium; and (d) casting said molten alloy into a mold.

4. A method of producing an iron-, nickel-, and cobalt-base alloy having an oxygen content of less than 0.003%, a sulphur content of less than 0.010%, and a nitrogen content of less than 0.010%, comprising the steps of:

(a) melting an alloy in a container selected from the group consisting of a lime crucible, a lime crucible furnace and a ladle lined with a basic refractory consisting of at least 40% calcium oxide (CaO), wherein said alloy consists essentially of at least one major ingredient selected from the group consisting of iron (Fe), nickel (Ni), and cobalt (Co);

(b) adding first and second additives and not more than 5% of a flux, based on the molten alloy, into said molten alloy in an atmosphere selected from the group consisting of a non-oxidizing atmosphere and a vacuum, wherein said first additive is selected from the group consisting of aluminum (Al), aluminum alloys, silicon (Si), and silicon alloys, wherein said second additive is selected from the group consisting of titanium (Ti), zirconium (Zr), niobium (Nb), boron (B), and rare earth elements, and wherein said flux contains aluminum oxide ($Al_2O_3$) and at least one compound selected from the group consisting of oxides, silicates, carbonates, and halides of alkali and alkaline earth metals, (c) desulphurizing, deoxidizing and denitrifying said molten alloy under an atmosphere selected from the group consisting of a non-oxidizing atmosphere and a vacuum, whereby the molten alloy contains 0.005 to 7.0% of residual aluminum, 0.005 to 7.0% of residual silicon, and 0.0005 to 0.005% of residual calcium; and (d) casting said molten alloy into a mold.

5. A method of producing an iron-, nickel-, and cobalt-based alloy having an oxygen content of less than 0.003%, a sulphur content of less than 0.010%, and a nitrogen content of less than 0.010%, comprising the steps of:

(a) charging a molten alloy in a container selected from the group consisting of a lime crucible, a lime crucible furnace and a ladle lined with a basic refractory consisting of at least 40% calcium oxide (CaO), wherein said alloy consists essentially of at least one major ingredient selected from the group consisting of iron (Fe), nickel (Ni), and cobalt (Co);

(b) adding at least one additive and not more than 5% of a flux, based on the molten alloy, into said molten alloy in an atmosphere selected from the group consisting of a non-oxidizing atmosphere and a vacuum, wherein said additive is selected from the group consisting of aluminum (Al), aluminum alloys, silicon (Si), and silicon alloys, and wherein said flux contains at least one compound selected from the group consisting of oxides, silicates, carbonates, and halides of alkali and alkaline earth metals.

(c) desulphurizing, deoxidizing and denitrifying said molten alloy under an atmosphere selected from the group consisting of a non-oxidizing atmosphere and a vacuum, whereby the molten alloy contains 0.005 to 7.0% of residual aluminu, 0.005 to 7.0% of residual silicon, and 0.0005 to 0.005% of residual calcium; and (d) casting said molten alloy into a mold.

6. A method as set forth in any of claims 1 through 5, wherein said non-oxidizing atmosphere is an argon gas atmosphere.

7. A method as set forth in any of claims 1 and 3, wherein said flux consists of calcium oxide and calcium fluoride ($CaF_2$).

8. A method as set forth in any of claims 2 and 4, wherein said flux consists of calcium oxide, calcium fluoride, and aluminum oxide.

9. A method as set forth in any of claims 1 through 5, wherein said basic refractory contains at least 60% of calcium oxide.

10. A method as set forth in any of claims 1 through 5, wherein said basic refractory contains at least 80% of calcium oxide.

11. A method as set forth in any of claims 1 through 5, wherein said basic refractory contains at least 90% of calcium oxide.

* * * * *